US008071015B2

(12) United States Patent
Wada et al.

(10) Patent No.: US 8,071,015 B2
(45) Date of Patent: Dec. 6, 2011

(54) PROCESS FOR PRODUCING POROUS METAL BODY

(75) Inventors: Tomohiro Wada, Tokyo (JP); Tomoyuki Haneji, Tokyo (JP); Shinichi Takahashi, Hiratsuka (JP); Kiichi Kanda, Hiratsuka (JP); Kenichi Watanabe, Hiratsuka (JP)

(73) Assignee: Taiyo Nippon Sanso Corporation, Tokyo (JP)

( * ) Notice: Subject to any disclaimer, the term of this patent is extended or adjusted under 35 U.S.C. 154(b) by 379 days.

(21) Appl. No.: 12/405,367

(22) Filed: Mar. 17, 2009

(65) Prior Publication Data

US 2009/0232692 A1 Sep. 17, 2009

(30) Foreign Application Priority Data

Mar. 17, 2008 (JP) ..... 2008-067001
Mar. 4, 2009 (JP) ..... 2009-050222

(51) Int. Cl.
*B22F 3/11* (2006.01)

(52) U.S. Cl. ..... 419/2; 419/53; 419/54; 419/56; 419/57; 419/58; 419/59; 419/60

(58) Field of Classification Search ..... 419/2, 30–37, 419/44, 53–60; 75/228, 245–250; *B22F 3/10, B22F 3/11, 3/24, 1/00; C22C 1/04, 1/06, C22C 1/08, 33/02; C21D 3/04, 1/74, 1/76, C21D 1/773*

See application file for complete search history.

(56) References Cited

U.S. PATENT DOCUMENTS 5,854,379 A * 12/1998 Takayama et al. ..... 528/338

FOREIGN PATENT DOCUMENTS

| | | | |
|---|---|---|---|
| CA | 2000034 | * | 4/1991 |
| JP | 06-158116 | | 6/1994 |
| JP | 2006-077272 | * | 3/2006 |

* cited by examiner

*Primary Examiner* — Scott Kastler
*Assistant Examiner* — Vanessa Velasquez
(74) *Attorney, Agent, or Firm* — Edwards Wildman Palmer LLP

(57) ABSTRACT

Disclosed is a process of producing a porous metal body containing a metal component which is likely to be oxidized, by which process the amounts of residual carbon and residual oxygen therein are decreased, and by which the performance of the product porous body can be largely promoted. The process for producing a porous metal body by sintering a material of the porous metal body, which material is obtained by coating a slurry containing a metal powder and an organic binder on an organic porous aggregate, comprises a defatting step of treating the material of the porous metal body at a temperature not higher than 650° C. in an atmosphere containing carbon monoxide and carbon dioxide; a decarbonization step of treating the material of the porous metal body after the defatting step in an inert atmosphere or vacuum atmosphere at a temperature not higher than sintering temperature; and a sintering step of retaining the material of the porous metal body after the decarbonization step in an inert atmosphere, vacuum atmosphere, hydrogen atmosphere, or in a reducing atmosphere containing hydrogen gas and an inert gas at a temperature not higher than the melting point of the metal powder.

8 Claims, 6 Drawing Sheets

PROCESS FOR PRODUCING POROUS METAL BODY

TECHNICAL FIELD

The present invention relates to a process for producing a porous metal body. More particularly, the present invention relates to a process for producing a porous metal body by sintering a material of the porous metal body, which material is obtained by coating a slurry containing a metal powder and an organic binder on an organic porous aggregate.

BACKGROUND ART

Powdery metallurgical products are now generally produced by press-molding a mixed powder of metal powder and a lubricant such as zinc stearate after packing the mixed powder into a die; and performing a defatting step and sintering step in an inert atmosphere or in a reducing atmosphere. In these cases, the shape of the product is retained by the mechanical tangling of the metal particles by the outer force exerted during the pressing in the die. The lubricant is added in an amount of about 0.5 to 1% by weight based on the metal powder, and mainly contributes to the promotion of the releasing property of the product and promotion of the packing property of the material powder into the die.

On the other hand, a process for producing a porous metal body is known wherein an organic porous body made of a resin foam such as polyurethane foam or the like is coated with a slurry containing metal powder and an organic binder, is defatted and sintered to obtain a porous metal body (see, for example, Patent Literature 1). By this method, before the initiation of the sintering of the metal powder, the shape is retained by the polyurethane foam at lower temperatures, and by the organic binder in the temperatures higher than the decomposition temperature of the polyurethane foam.

As the organic binder which is required to exist without being decomposed up to the sintering initiation temperature, a substance which is easy to be carbonized, such as a phenol resin, is used in many cases. With a metal which is easy to be reduced such as nickel or copper, the region wherein carbon is oxidatively decomposed and the metal, for example, nickel is reductively sintered is the Region I in the Ellingham diagram shown in FIG. 1. Since this Region I exists in the area higher than 500° C. which is relatively cold, and the widths of the oxidation-reduction conditions of carbon and the oxidation-reduction conditions of nickel are large, a porous metal body having decreased residual carbon amount and decreased residual oxygen amount can be produced by controlling the composition of the atmosphere during sintering.

Patent Literature 1: JP 6-158116 A

DISCLOSURE OF THE INVENTION

Problem to be Solved by the Invention

However, when a stainless steel porous body is to be produced by the method described in Patent Literature 1, there is a region in which chromium contained in the stainless steel is reduced similar to nickel and copper. Since the chromium is a metal which is not easy to be reduced, the region wherein chromium is reduced exists in the area not lower than a high temperature of 1200° C. as indicated as Region II in the Ellingham diagram shown in FIG. 2. Further, since the widths of the oxidation-reduction conditions of carbon and the oxidation-reduction conditions of chromium are narrow, it is difficult to select a condition where carbon is oxidatively removed while chromium is not oxidized.

Further, in cases where the treatment is carried out under a condition where chromium is not oxidized, carbon is reduced in most cases, so that carbon originated from the organic binder remains in the final product in a large amount. As a result, the heat resistance, corrosion resistance or magnetic characteristics is largely influenced. Still further, in cases where the amount of carbon is large, since the melting point is lowered to about 1150° C., the material during sintering is melted, so that a product cannot be obtained in some cases.

By the treatment in a reducing atmosphere containing hydrogen gas, the carbon may be removed by gasification by the reaction between carbon and hydrogen to yield a hydrocarbon such as methane. However, at the temperature of about 1300° C. which is the sintering temperature of stainless steel, the reaction rate between hydrogen and carbon is very low, so that a long time is needed for the decarbonization. On the other hand, contrary to the treatment under the reducing conditions, in cases where the treatment is carried out in a region where the carbon is oxidatively decomposed, chromium is also simultaneously oxidized in most cases, and the diffusion bonding between the metal powder is inhibited by the oxide generated, so that insufficient sintering is caused.

Thus, with the stainless steel porous body produced by the method wherein the polyurethane foam is coated with a slurry containing the organic binder and metal powder, the amount of carbon contained in the product is higher than that in the general sintered metal products because the defatting and sintering are carried out in the reducing region of chromium. As a result, sufficient performance demanded for the product, such as magnetic characteristics, corrosion resistance, heat resistance and mechanical properties, may not be obtained.

Accordingly, an object of the present invention is to provide a process for producing a porous metal body containing a metal component which is easy to be oxidized, such as chromium, by which the amounts of the residual carbon and residual oxygen can be kept small and, in turn, the performance of the porous body product can be largely promoted.

Means for Solving the Problem

To attain the above-described object, the present invention provides a process for producing a porous metal body by sintering a material of the porous metal body, which material is obtained by coating a slurry containing a metal powder and an organic binder on an organic porous aggregate, which process comprises a defatting step of treating the material of the porous metal body at a temperature not higher than 650° C. in an atmosphere containing carbon monoxide and carbon dioxide; a decarbonization step of treating the material of the porous metal body after the defatting step in an inert atmosphere or vacuum atmosphere at a temperature not higher than sintering temperature; and a sintering step of retaining the material of the porous metal body after the decarbonization step in an inert atmosphere, vacuum atmosphere, hydrogen gas atmosphere, or in a reducing atmosphere containing hydrogen gas and an inert gas at a temperature not lower than the temperature in the decarbonization step and not higher than the melting point of the metal powder.

The present invention further provides a process according to the above-described process of the present invention, wherein the gas used for constituting the atmosphere in the defatting step is an exothermic converted gas containing carbon monoxide and carbon dioxide, which was obtained by partially oxidizing a mixed gas of a hydrocarbon(s) and air, a mixed gas of a hydrocarbon(s) and oxygen, or a mixed gas of a hydrocarbon(s), oxygen and nitrogen. The present invention still further provides a process according to the above-described process of the present invention, wherein the defatting step is in oxidative region to the metal powder, and in reducing region to carbon. The present invention still further provides a process according to the above-described process of the present invention, wherein the material of the porous metal body after the defatting step contains residual oxygen in an amount equal to or larger than residual carbon contained therein. The present invention still further provides a process according to the above-described process of the present invention, wherein the metal powder contains chromium.

Effects of the Invention

By the process of producing a porous metal body according to the present invention, in a process for producing a porous metal body containing a metal component which is easy to be oxidized, such as chromium, the amounts of the residual carbon and residual oxygen can be kept small and porous metal body with high performance can be obtained stably.

BEST MODE FOR CARRYING OUT THE INVENTION

In the process of the present invention, by which a porous metal body is produced from a material of the porous metal body, which material has an organic porous aggregate coated with a slurry containing metal powder and an organic binder, a defatting step of treating the material in an atmosphere containing carbon monoxide and carbon dioxide; a decarbonization step in an inert atmosphere or vacuum atmosphere; and a sintering step of treating the material in an inert atmosphere, vacuum atmosphere or a reducing atmosphere containing hydrogen gas, are carried out in the order mentioned.

First, the material of the porous metal body used in the present invention can be obtained by a conventional method. That is, an organic porous aggregate such as polyurethane foam is coated with a slurry containing a desired metal powder and an organic binder which is easy to be carbonized, such as a phenol resin, may be used as the material of the porous metal body. The steps of producing the porous metal body from the material thereof wherein a polyurethane foam is used as the aggregate, stainless steel is used as the metal powder and phenol resin is used as the organic binder will now be described in detail step by step.

Figure 1:
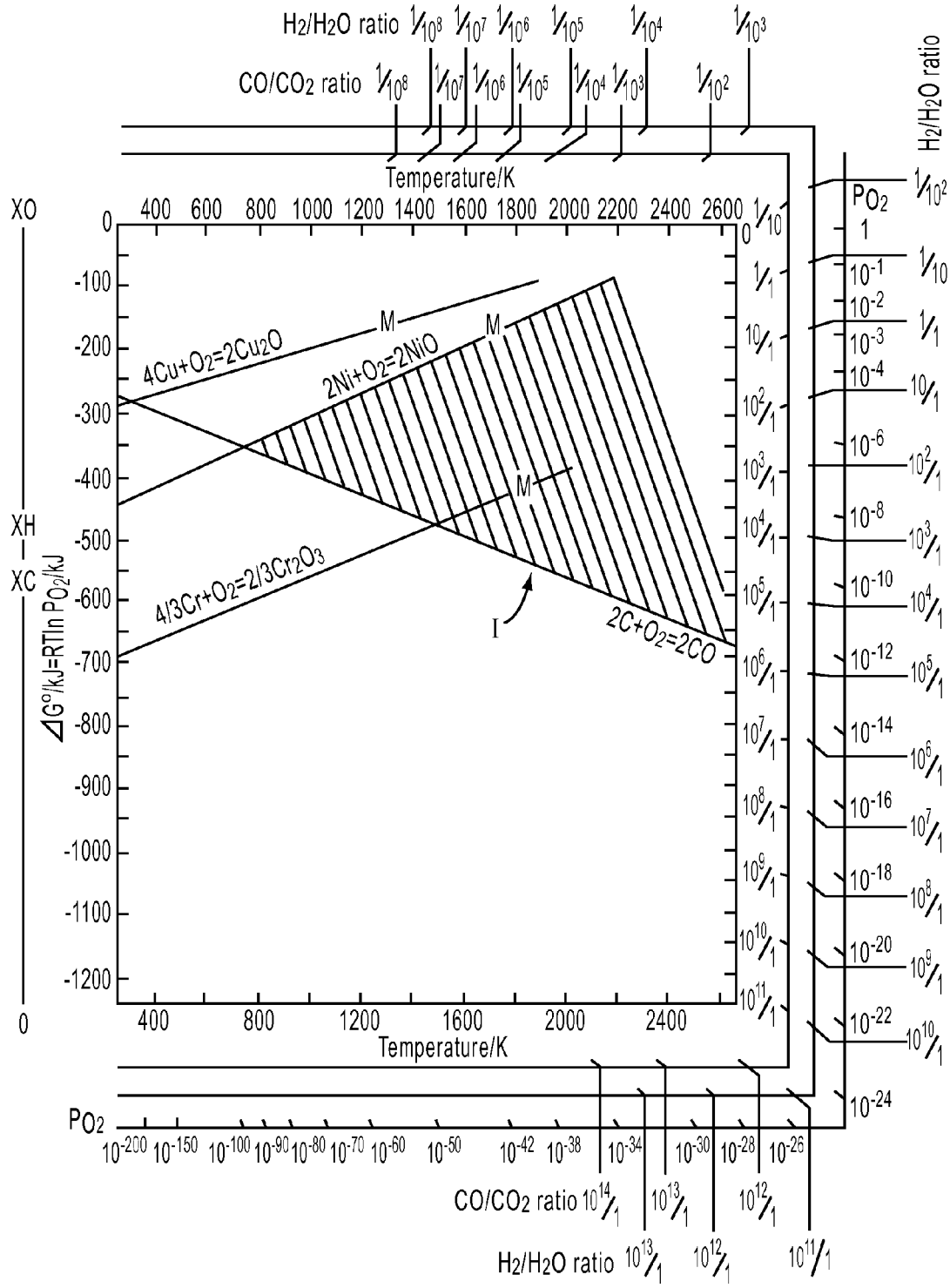
FIG. 1 is an Ellingham diagram showing the region wherein nickel is reduced and carbon is oxidized.
Figure 2:
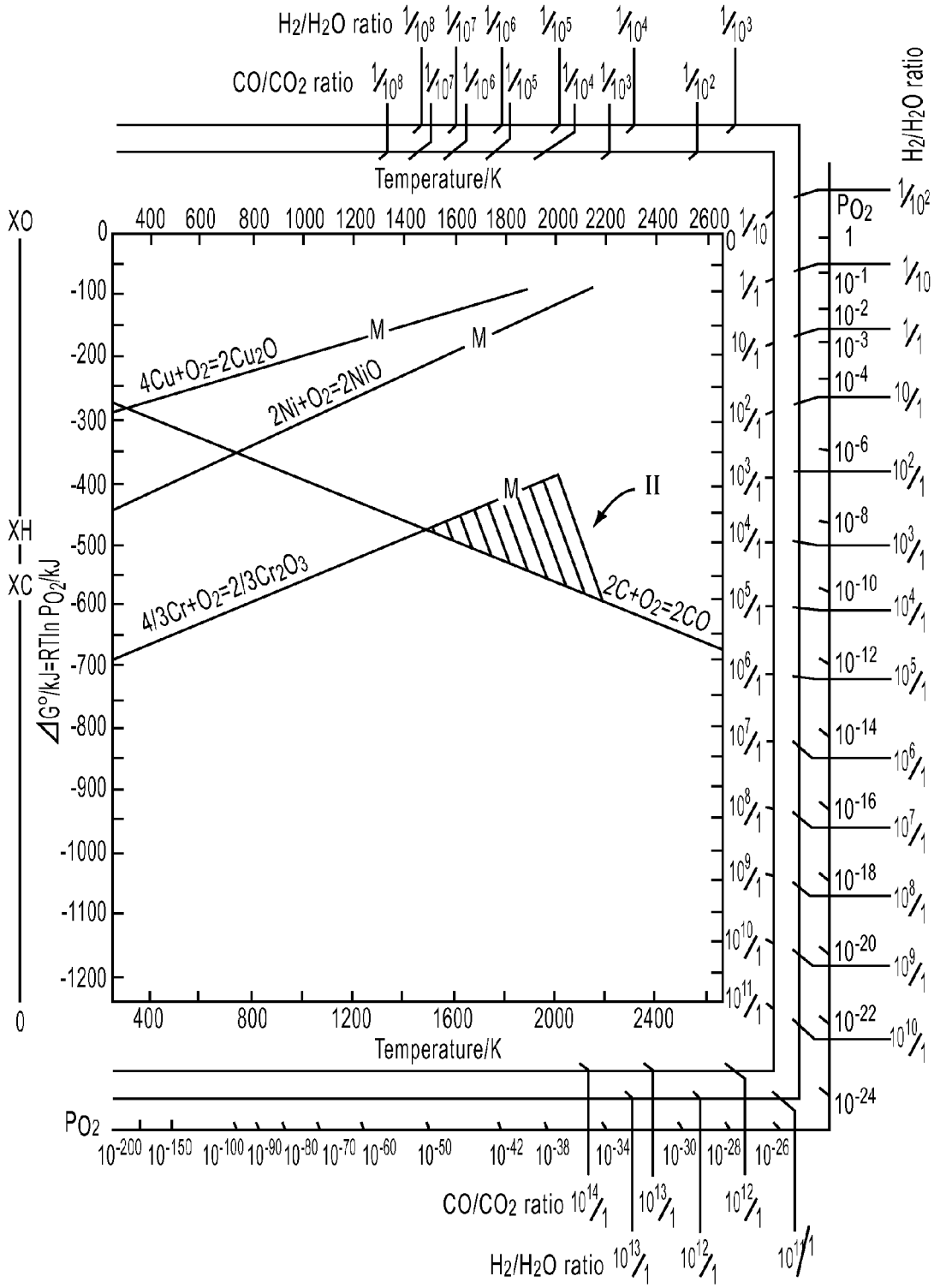
FIG. 2 is an Ellingham diagram showing the region wherein chromium is reduced and carbon is oxidized.
Figure 3:
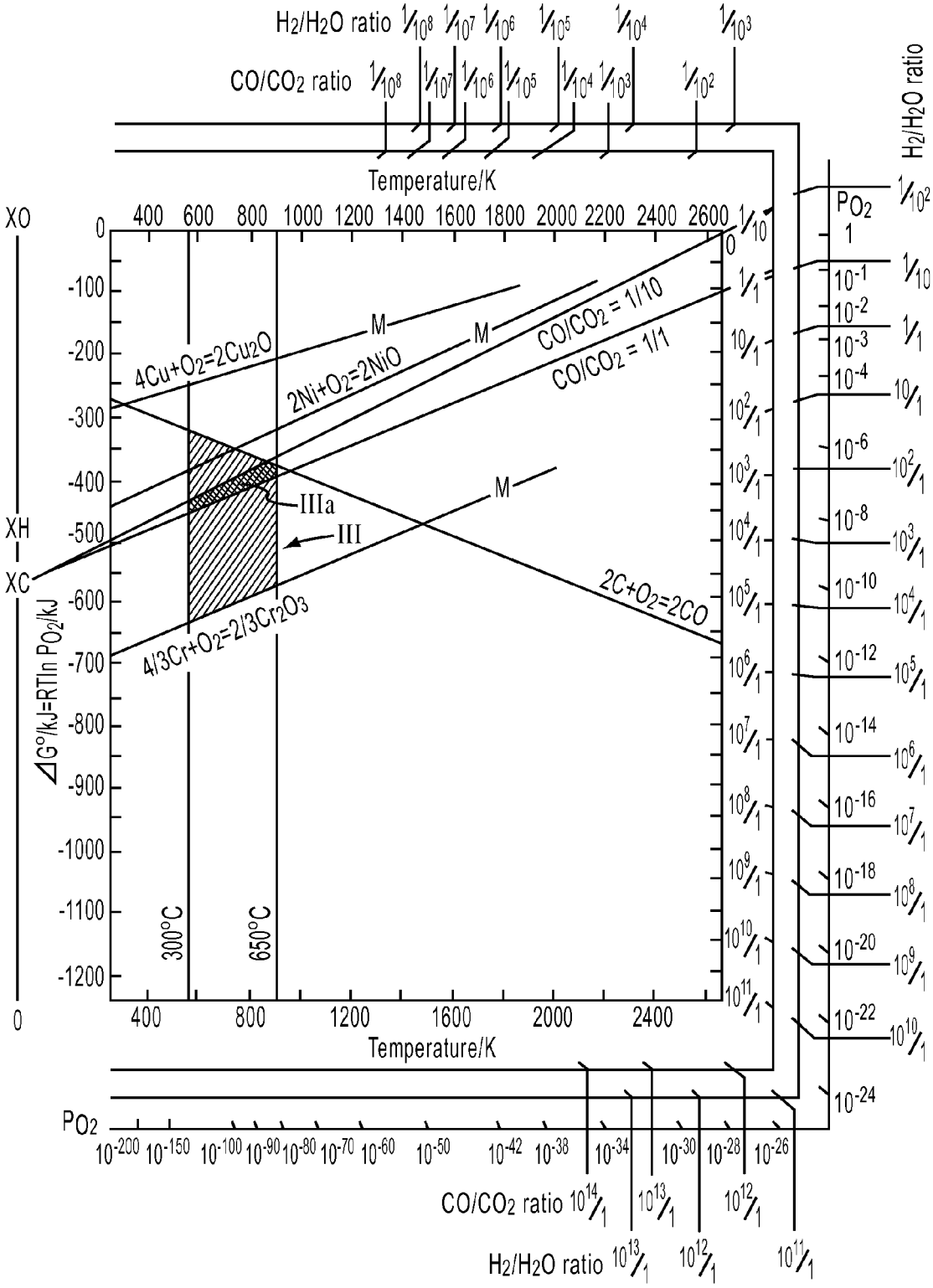
FIG. 3 is an Ellingham diagram showing the region where the defatting step in the process of the present invention is carried out.

The first step is the above-described defatting step for decomposing the organic compounds in the material of the porous metal body, that is, the organic compounds in the above-described aggregate and the above-described organic binder, and for oxidizing chromium in the stainless steel without oxidizing the decomposed carbon, by heating the material of the porous body in an atmosphere containing carbon monoxide and carbon dioxide. This step is carried out in Region III shown in the Ellingham diagram shown in FIG. 3, which is an oxidative region to chromium and a reducing region to carbon.

Although the atmosphere used in the defatting step may be provided by introducing carbon monoxide and carbon dioxide into a treatment furnace (defatting furnace), the atmosphere can be provided inexpensively by using an exothermic converted gas obtained by partially oxidizing a mixed gas of a hydrocarbon(s) and air, a mixed gas of a hydrocarbon(s) and oxygen, or a mixed gas of a hydrocarbon(s), oxygen and nitrogen. The reducing atmosphere most preferably has a $CO/CO_2$ ratio of 1/1, and the imperfect combustion region indicated by Region IIIa in FIG. 3 having a $CO/CO_2$ ratio of 1/1 to 1/10 for suppressing oxidation is preferred.

To suppress excess oxidation of the metal in the defatting step, it is preferred, in generating the exothermic converted gas, to set a mixing ratio of the air, oxygen or oxygen-containing nitrogen to the hydrocarbon(s) to the theoretical air fuel ratio (perfect combustion state) or to a region wherein the hydrocarbon(s) is(are) excess (imperfect combustion state). The exothermic converted gas containing 3% by volume of carbon monoxide and 11% by volume of carbon dioxide ($CO/CO_2$ ratio=1/3.7) generated when the air fuel ratio is set to 90% by volume is most preferred.

The heating temperature in the defatting step is set to a temperature at which defatting can be attained. That is, the heating temperature is set to a temperature range from a temperature not lower than the temperature at which the organic porous body constituting the aggregate and the organic binder are decomposed, that is, in the exemplified case mentioned above, not lower than 300° C. which is the decomposition temperature of polyurethane foam, and to a temperature at which the metal in the material of the porous metal body, especially, chromium in the stainless steel is not drastically oxidized, that is, a temperature not higher than 650° C.

The heating temperature and the heating time in the defatting step are set such that the amounts of the residual oxygen and the residual carbon in the material of the porous metal body after the defatting treatment are equal or the amount of the residual oxygen is excess to the residual carbon by about 10 to 20% by weight. In this case, if the defatting treatment is carried out under the conditions under which the amount of the residual oxygen is excess to the residual carbon by more than 20% by weight, the amount of the residual oxygen in the material of the porous metal body after the subsequent decarbonization step is too large, so that diffusion bonding in the sintering step between the metal each other may be inhibited and insufficient sintering may be caused in some cases.

Figure 4:
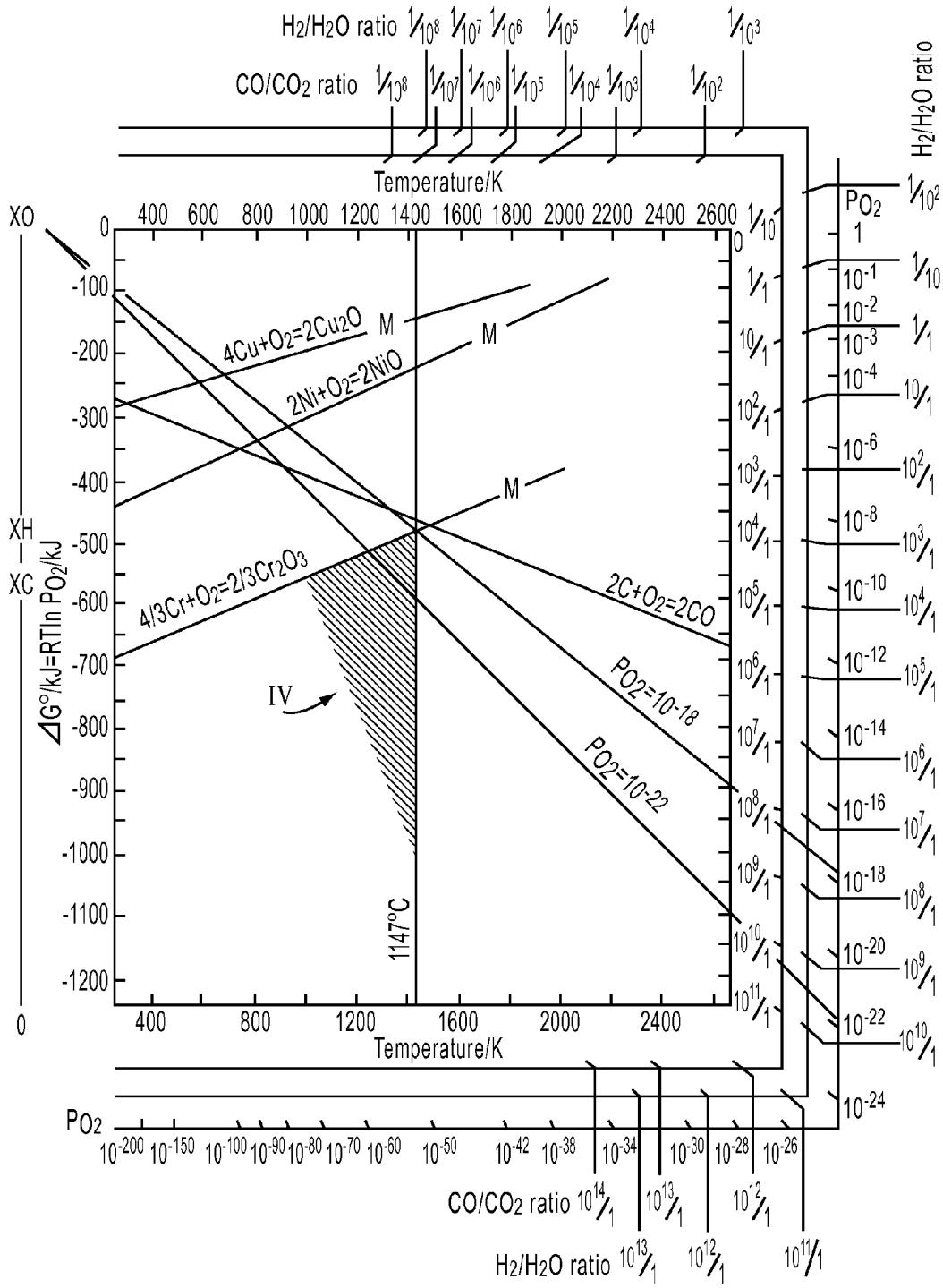
FIG. 4 is an Ellingham diagram showing the region where the decarbonization step in the process of the present invention is carried out.

The second step is the decarbonization step for removing carbon from the material of the porous metal body by reducing the chromium oxide generated by oxidation in the defatting step, and reacting the oxygen with carbon to generate carbon monoxide and/or carbon dioxide. This step is carried out in Region IV in the Ellingham diagram shown in FIG. 4, which is a reducing region to both chromium and carbon. In this decarbonization step, to eliminate the influence by oxygen, the oxygen partial pressure ($P_{O2}$) is preferably in the range between $10^{-18}$ to $10^{-22}$ atm. The $P_{O2}$ of $10^{-22}$ atm is a vacuum inert region which can be industrially attained, and the $P_{O2}$ of $10^{-18}$ atm is the value obtained from the point of intersection between 1147° C. and the base line of oxidation-reduction of chromium, and from the oxygen base point, which is described below.

In this decarbonization step, the material of the porous metal body after the defatting step (defatted body) is heated in an inert atmosphere such as argon, helium or nitrogen at a temperature not lower than the temperature in the defatting step and not higher than the temperature in the sintering step, and the residual carbon and residual oxygen in the defatted body are sufficiently reacted to convert them to carbon monoxide and/or carbon dioxide, thereby carrying out decarbonization.

As for the treatment temperature in the decarbonization step, it is preferred to carry out the treatment at a high temperature so that the reaction between the carbon and oxygen in the defatted body well proceeds. However, in the temperature region higher than 1147° C., a part of the metal is melted when the amount of the residual carbon in the defatted body is large, so that it is preferred to carry out the treatment at a temperature not higher than 1147° C. In cases where the amount of the residual carbon in the defatted body is not more than 2% by weight, however, rapid decarbonization treatment in the temperature range higher than 1147° C. may also be carried out.

If this decarbonization step is carried out in a reducing atmosphere containing hydrogen or the like, the oxygen in the defatted body is selectively removed by the reaction between the reducing component in the atmosphere and the oxygen in the defatted body, so that the carbon which cannot react with the oxygen is left over in the defatted body. Thus, the decarbonization step cannot be carried out in a reducing atmosphere.

The third step is the sintering step for binding the metal each other in the material of the porous metal body from which carbon was removed in the decarbonization step. The sintering step is carried out in Region V in the Ellingham diagram shown in FIG. 5 in an inert atmosphere or vacuum atmosphere, or in Region VI in the Ellingham diagram shown in FIG. 6 in a hydrogen atmosphere or a reducing atmosphere of a mixed gas of hydrogen and an inert gas.

Figure 5:
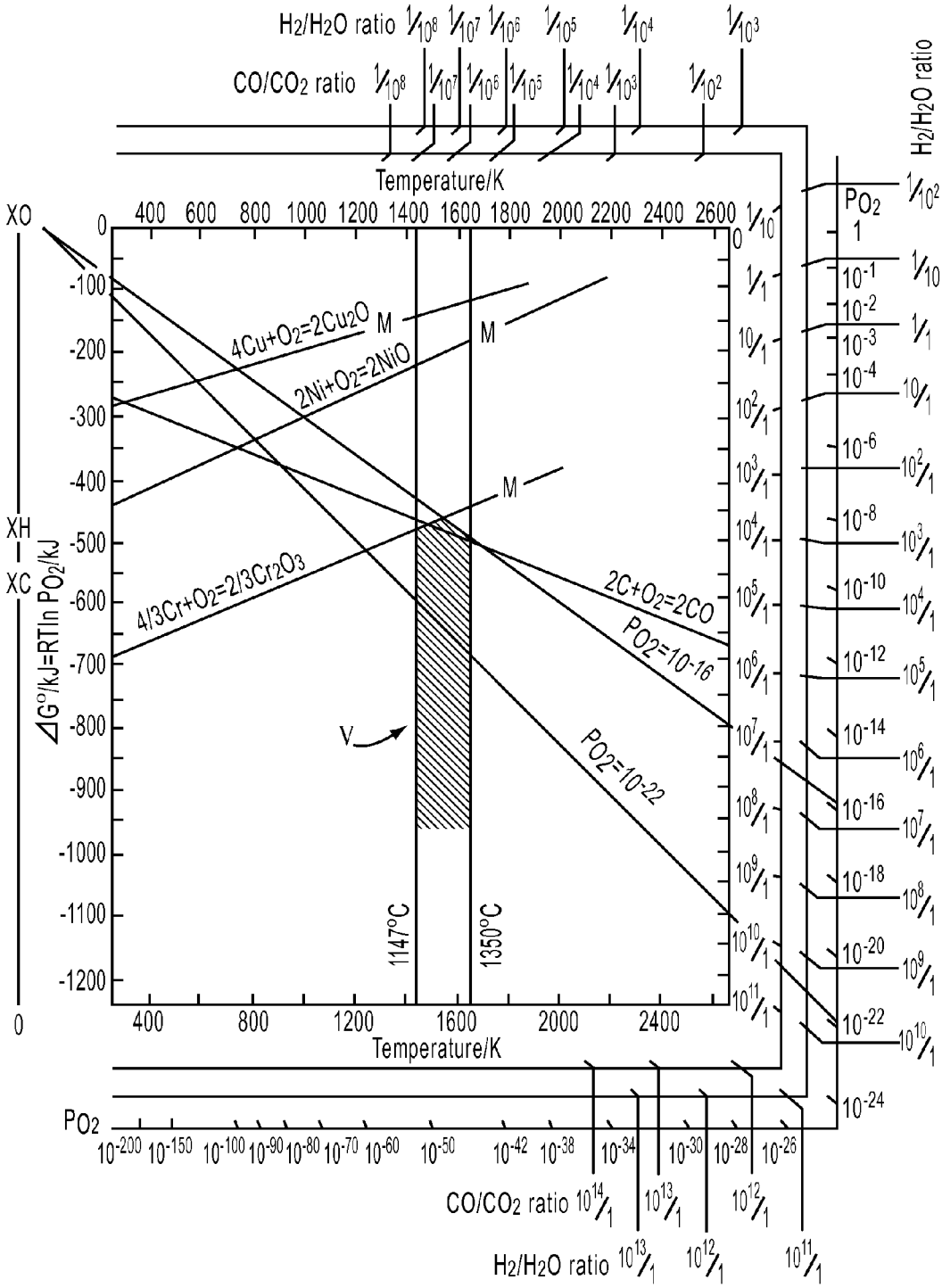
FIG. 5 is an Ellingham diagram showing the region where the sintering step in the process of the present invention is carried out.
Figure 6:
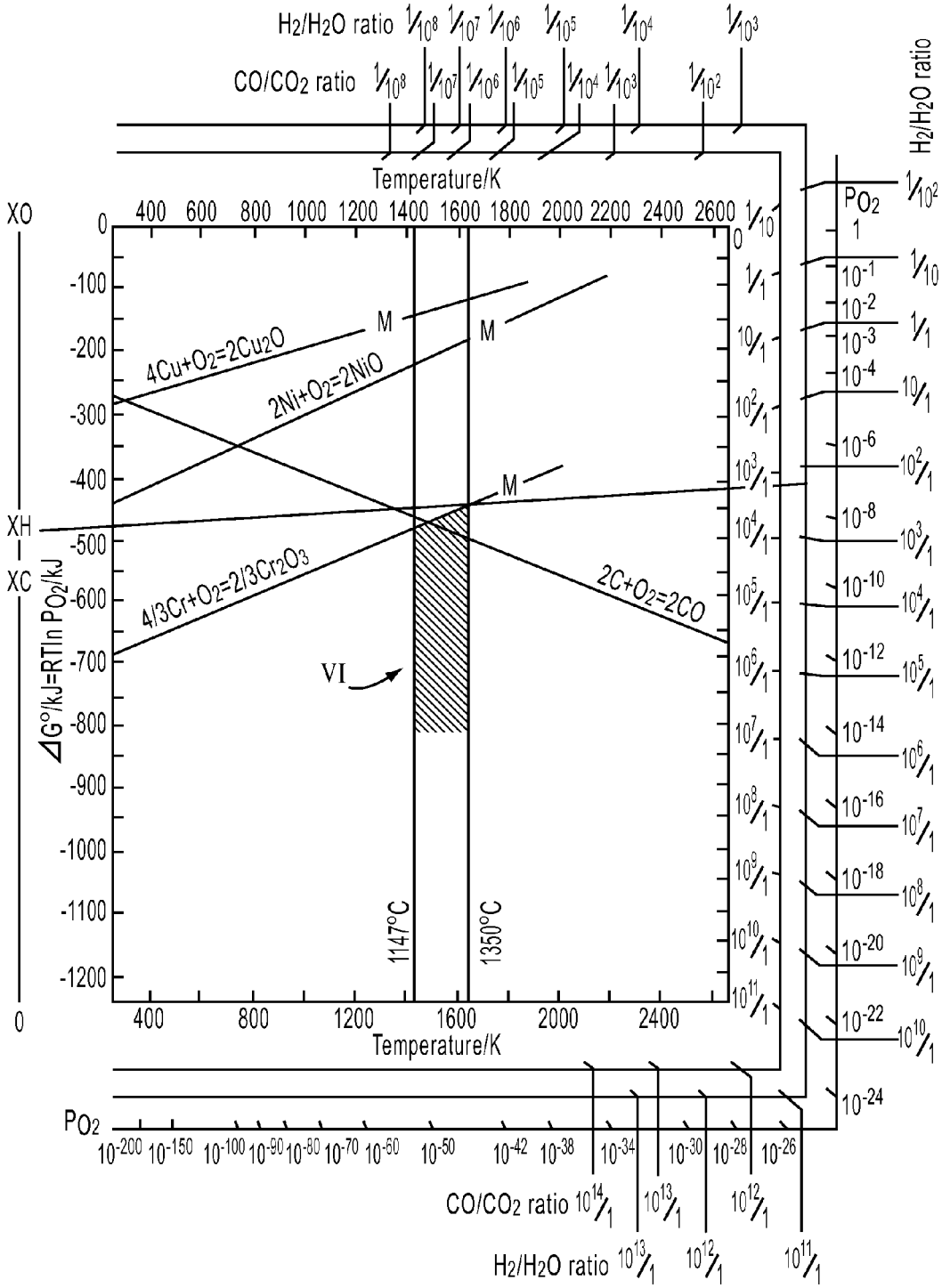
FIG. 6 is an Ellingham diagram showing another region where the defatting step in the process of the present invention is carried out.

The 1350° C. shown in Region V in FIG. 5 is the upper limit of the sintering temperature of stainless steel, and the $P_{O2}$ of about $10^{-6}$ atm is the value obtained from the point of intersection between 1350° C. and the oxidation-reduction base line of carbon, and from the oxygen base point. Further, in Region VI in FIG. 6, the $H_2/H_2O$ ratio of about $2\times10^2/1$ is obtained from the point of intersection between 1350° C. and the oxidation-reduction base line of chromium, and from the hydrogen base point. This indicates a control value of the $H_2O$ (dew point) generated by the entry of the oxide, product and air into the furnace due to the heat treatment in the sintering furnace in a hydrogen atmosphere or hydrogen-argon atmosphere.

In this sintering step, the material of the porous metal body after the decarbonization step (decarbonized body) is heated in an inert atmosphere of such as argon, helium or nitrogen; vacuum atmosphere; hydrogen atmosphere; or a reducing atmosphere of a mixed gas containing hydrogen and an inert gas such as argon, helium or nitrogen, at a temperature not lower than the temperature in the decarbonization step and not higher than the melting point of the metal constituting the metal powder, thereby to remove the residual oxygen and to carry out the sintering reaction between the metal powder by diffusion bonding. By this step, a sintered porous metal body which is the final product can be obtained.

Thus, in the production of a porous metal body using metal powder of stainless steel, by carrying out the defatting step by heating in the atmosphere which is oxidative to chromium and reductive to carbon; the decarbonization step by heating in an inert atmosphere or vacuum atmosphere; and the sintering step by heating in the inert atmosphere, vacuum atmosphere or the reducing atmosphere containing hydrogen, a sintered porous metal body having a decreased residual carbon and residual oxygen can be obtained.

Although each of the above-described steps can be carried out in continuous furnaces or in the same treatment furnace, since the composition of the atmosphere in the defatting step is largely different from those in the subsequent decarbonization step and in the sintering step, it is preferred to carry out the defatting treatment using a defatting furnace which is used only for the defatting step in order to eliminate the influence by the oxidative components on the decarbonization step and the sintering step. In cases where the same atmosphere (inert atmosphere or vacuum atmosphere) is used in the decarbonization step and in the sintering step, the same treatment furnace may be used, and a continuous treatment can be attained by employing an appropriate temperature program in case of using a vacuum furnace or batch type atmosphere furnace; or by controlling the temperatures of the respective zones to those suited for the decarbonization step and the sintering step, respectively, in case of using a continuous atmosphere furnace.

Further, although in the above-described description, stainless steel is used as the metal powder and chromium contained in the stainless steel is exemplified as the metal component likely to be oxidized, the process of the present invention is not restricted to the process using stainless steel, but may be applied to the metal powder containing a metal component which is likely to be oxidized, such as manganese, silicon, vanadium or titanium.

What is claimed is:

1. A process for producing a porous metal body by sintering a material of said porous metal body, obtained by coating a slurry containing a metal powder and an organic binder on an organic porous aggregate, said process comprising:

a defatting step of treating said material of said porous metal body at a temperature not higher than 650° C. in an atmosphere containing carbon monoxide and carbon dioxide;

a decarbonization step of treating said material of said porous metal body after said defatting step in an inert atmosphere or vacuum atmosphere at a temperature not higher than sintering temperature; and a sintering step of retaining said material of said porous metal body after said decarbonization step in an inert atmosphere, vacuum atmosphere, hydrogen gas atmosphere, or in a reducing atmosphere containing hydrogen gas and an inert gas at a temperature not lower than said temperature in said decarbonization step and not higher than the melting point of said metal powder, wherein said atmosphere in said defatting step is in oxidative region to said metal powder, and in reductive region to carbon.

2. The process according to claim 1, wherein said metal powder contains chromium.

3. The process according to claim 1, wherein said material of said porous metal body after said defatting step contains residual oxygen in an amount equal to or larger than residual carbon contained therein.

4. The process according to claim 3, wherein said metal powder contains chromium.

5. The process according to claim 1, wherein said gas used for constituting said atmosphere in said defatting step is an exothermic converted gas containing carbon monoxide and carbon dioxide, which was obtained by partially oxidizing a mixed gas of a hydrocarbon(s) and air, a mixed gas of a hydrocarbon(s) and oxygen, or a mixed gas of a hydrocarbon(s), oxygen and nitrogen.

6. The process according to claim 5, wherein said metal powder contains chromium.

7. The process according to claim 5, wherein said material of said porous metal body after said defatting step contains residual oxygen in an amount equal to or larger than residual carbon contained therein.

8. The process according to claim 7, wherein said metal powder contains chromium.

* * * * *